United States Patent [19]

Dixon et al.

[11] Patent Number: 5,047,707

[45] Date of Patent: Sep. 10, 1991

[54] VOLTAGE REGULATOR AND METHOD FOR SUBMICRON CMOS CIRCUITS

[75] Inventors: Robert P. Dixon, Chandler; Walter C. Seelbach, Fountain Hills, both of Ariz.

[73] Assignee: Motorola, Inc., Schaumburg, Ill.

[21] Appl. No.: 615,684

[22] Filed: Nov. 19, 1990

[51] Int. Cl.[5] ..... G05F 3/16

[52] U.S. Cl. ..... 323/314; 307/296.6; 307/491

[58] Field of Search ..... 323/313, 314; 307/296.1, 264, 296.6, 491; 330/288

[56] References Cited

U.S. PATENT DOCUMENTS

| | | | |
|---|---|---|---|
| 3,975,648 | 8/1976 | Tobey, Jr. et al. | 307/297 |
| 4,644,194 | 2/1987 | Birrittella et al. | 307/475 |
| 4,656,415 | 4/1987 | Droxelmayr | 323/314 |
| 4,677,369 | 6/1987 | Bowers et al. | 323/314 |
| 4,742,292 | 5/1988 | Hoffman | 323/314 |

FOREIGN PATENT DOCUMENTS 633157G 11/1982 Switzerland .

OTHER PUBLICATIONS

RCA Technical Notes, TN No. 1220, Dec. 29, 1978, Self Stabilizing Voltage Reference, Stewart, Roger Green.

*Primary Examiner*—William H. Beha, Jr.
*Assistant Examiner*—Bruce Dunn
*Attorney, Agent, or Firm*—Bradley J. Botsch

[57] ABSTRACT

A circuit is provided that generates a predetermined regulated voltage between first and second terminals that is positioned between first and second power supply voltage rails wherein the predetermined regulated voltage is substantially independent of temperature and power supply variation. The circuit includes a bandgap circuit for providing a predetermined reference potential that is substantially independent of temperature and power supply variation. A resistive circuit provides first and second voltages which are referenced with respect to the first supply voltage rail. A level translator circuit translates the second voltage provided by the resistive circuit to a third voltage which is referenced with respect to the second supply voltage rail. First and second operational amplifier circuits are provided for respectively transferring the first and third voltages respectively to first and second terminals wherein a voltage developed between the first and second terminals is substantially equal to the predetermined reference voltage of the bandgap circuit.

8 Claims, 2 Drawing Sheets

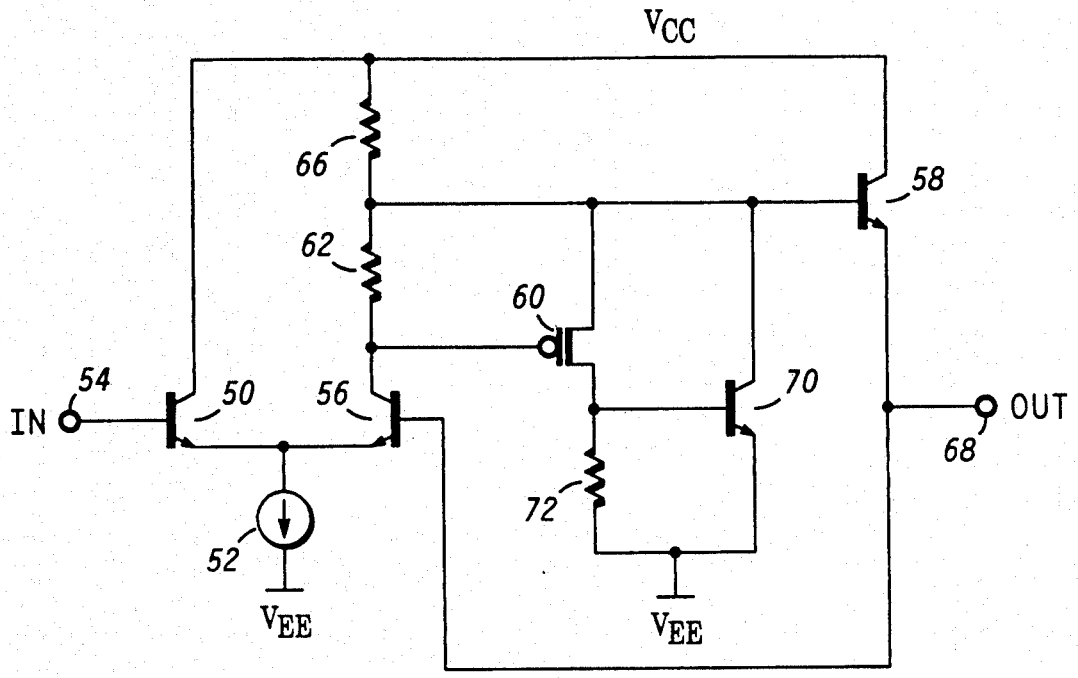
FIG. 2
FIG. 3
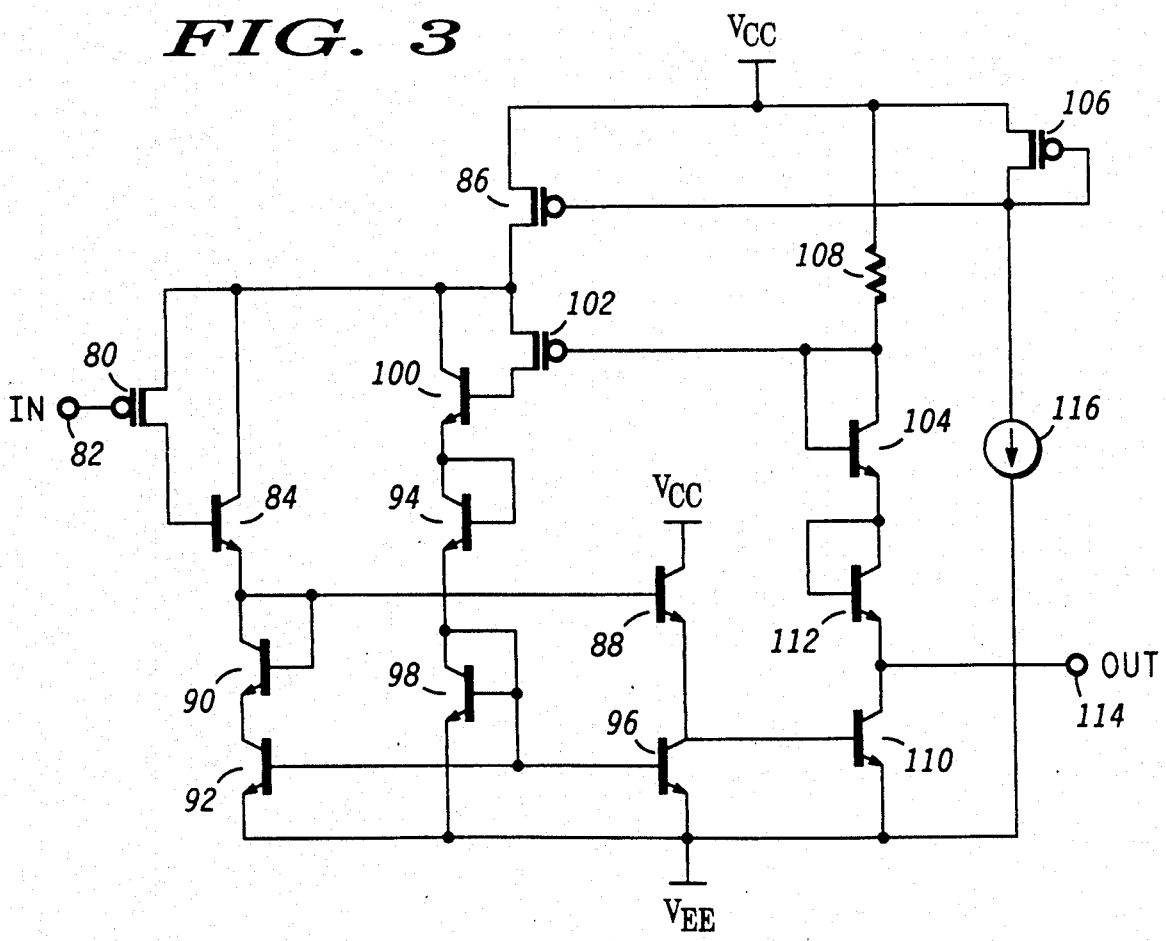

VOLTAGE REGULATOR AND METHOD FOR SUBMICRON CMOS CIRCUITS

CROSS RELATED REFERENCES

The subject matter of the present invention is related to the subject matter of a pending patent application filed June 4, 1990, entitled "Voltage Reference Circuit With Power Supply Compensation" and having Ser. No. 533,199, and to the subject matter of U.S. Pat. No. 4,644,194, entitled "ECL to TTL Voltage Level Translator" and having an issue date of Feb. 17, 1987.

BACKGROUND OF THE INVENTION

This invention relates to voltage regulators such as a submicron CMOS voltage regulator circuit for providing a predetermined regulated voltage that is offset between first and second supply voltage rails.

Submicron CMOS circuits typically refers to CMOS circuits that include transistors having submicron gate lengths. In an effort to avoid reliability problems associated with high electric fields in the gate-drain region, CMOS circuits having submicron dimensions typically require a voltage supply not to exceed 3.3 volts instead of the typical 5 volts supply for CMOS circuits. The problem then arises of providing a reduced regulated power supply from an already existing 5 volt power supply.

One obvious solution to generating a reduced power supply is to insert diodes between each power supply rail which reduces the rail thereby causing a drop in voltage by the voltage dropped power each diode. However, it should be realized that the voltage drop across the diodes will vary with temperature and current, as is well known. This would have a negative effect of providing an unregulated power supply for a submicron CMOS circuit.

Hence, a need exists for a circuit providing a predetermined regulated voltage positioned between first and second supply voltage rails that is substantially independent of temperature and power supply variations.

SUMMARY OF THE INVENTION

Briefly, the present invention provides a circuit having first and second supply voltage rails comprising a bandgap circuit, coupled between a node and the second supply voltage rail, for providing a predetermined reference voltage across the bandgap circuit, the predetermined reference voltage being substantially independent of temperature and power supply variation; a resistive circuit, having first and second outputs, for providing voltages which are referenced with respect to the first supply voltage rail; a level translator circuit having an input coupled to the second output of the resistive circuit for translating the voltage at the second output of the resistive circuit to a voltage at an output, the voltage at the output of the level translator circuit being referenced with respect to the second supply voltage rail; a first operational amplifier circuit coupled to the first output of the resistive circuit for transferring the voltage at the first output of the resistive circuit to a first terminal, the first operational amplifier circuit being capable of sourcing current; and a second operational amplifier circuit coupled to the output of the level translator circuit for transferring the voltage at the output of the level translator circuit to a second terminal wherein a voltage developed between the first and second terminals is substantially equal to the predetermined reference voltage of the bandgap circuit, the second operational amplifier circuit being capable of sinking current.

An advantage of the present invention is that a predetermined voltage is produced between first and second supply voltage rails that is substantially independent of temperature and power supply variation such that the predetermined voltage is compatible with submicron CMOS technology.

The above and other features and advantages of the present invention will be better understood from the following detailed description taken in conjunction with the accompanying drawings.

BRIEF DESCRIPTION OF THE DRAWINGS

FIG. 2 is a detailed schematic diagram of one implementation of an operational amplifier circuit for sourcing current; and FIG. 3 is a detailed schematic diagram of one implementation of an operational amplifier circuit for sinking current.

DETAILED DESCRIPTION OF THE INVENTION

Figure 1:
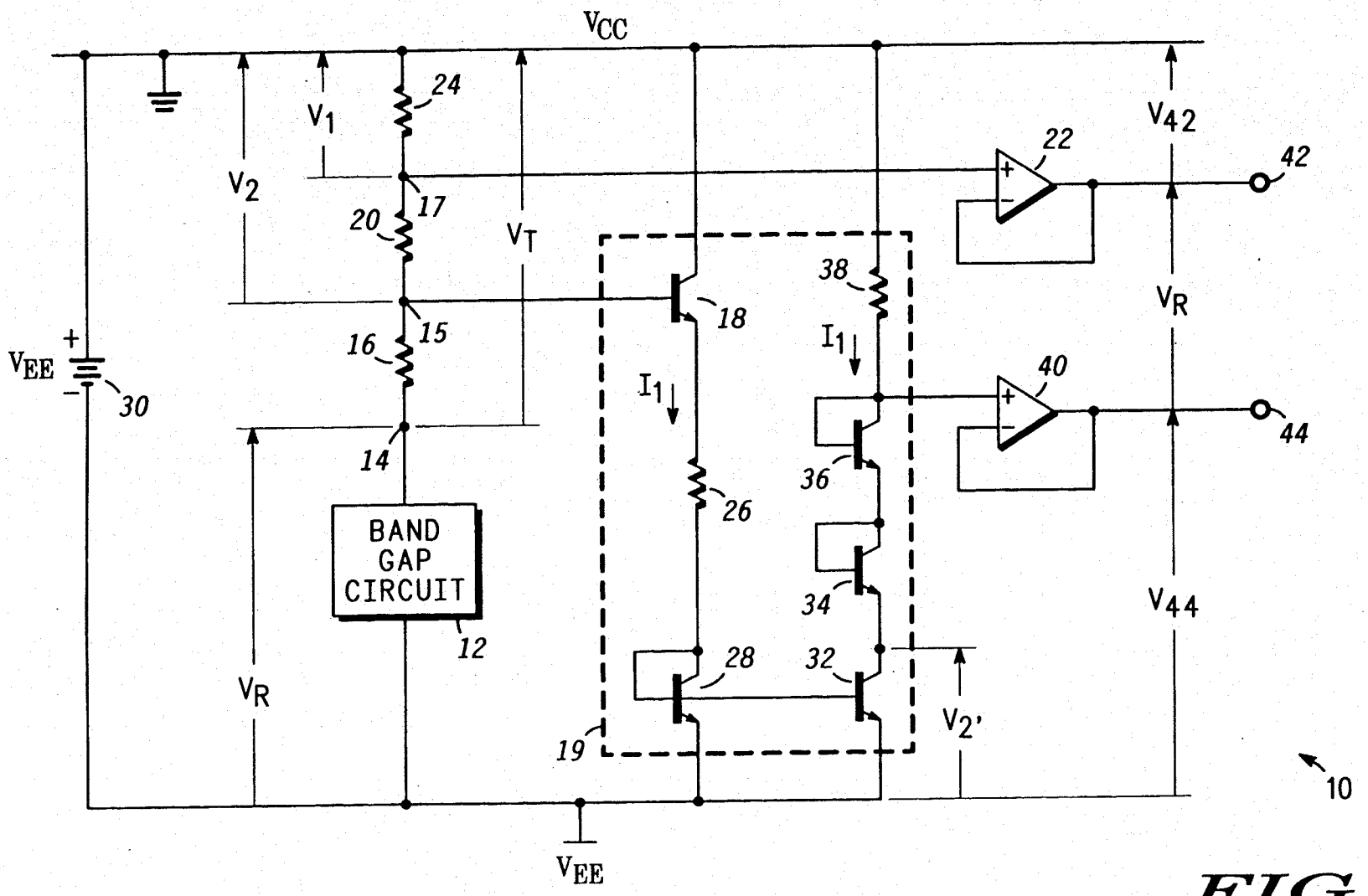
FIG. 1 is a partial schematic diagram illustrating the CMOS voltage regulator circuit in accordance with the present invention.

Referring to FIG. 1, CMOS voltage regulator 10 of the present invention is shown comprising bandgap circuit 12 coupled between circuit node 14 and a power supply rail at which the operating potential $V_{EE}$ is applied. Bandgap circuit 12 provides reference voltage $V_R$ between the $V_{EE}$ power supply rail and circuit node 14. A resistor circuit including resistors 16, 20 and 24, and having first and second outputs respectively at nodes 17 and 15 is coupled between circuit node 14 and a power supply rail at which the operating potential $V_{CC}$ is applied. The resistor circuit functions to absorb the voltage difference between operating potentials $V_{CC}$ and $V_{EE}$ lessened by reference potential $V_R$. In particular, resistor 16 is coupled between nodes 14 and 15. Resistor 20 is coupled between nodes 15 and 17, and resistor 24 is coupled between the node 17 and the $V_{CC}$ power supply rail.

Level translator circuit 19 includes transistor 18 which has a base coupled to node 15. Further, the collector of transistor 18 is coupled to the $V_{CC}$ power supply rail while the emitter of transistor 18 is coupled through resistor 26 to the base and collector of transistor 28. The emitter of transistor 28 is coupled to the $V_{EE}$ power supply rail. The $V_{CC}$ power supply rail is coupled to the $V_{EE}$ power supply rail by battery 30 which supplies a potential of $V_{EE}$. Further, the base of transistor 28 is coupled to the base of transistor 32, the latter having an emitter coupled to the $V_{EE}$ power supply rail. The collector of transistor 32 is coupled to the emitter of transistor 34, while the base and collector of transistor 34 are coupled to the emitter of transistor 36. The base and collector of transistor 36 are coupled through resistor 38 to the $V_{CC}$ power supply rail.

Operational amplifier circuit 22 has a non-inverting input coupled to node 17. Further, the output of operational amplifier circuit 22 is coupled to the inverting input of operational amplifier circuit 22 and to terminal 42. Likewise, operational amplifier circuit 40 has a non-inverting input coupled to the collector of transistor 36 while the output of operational amplifier circuit 40 is coupled to the inverting input of operational amplifier circuit 40 and to terminal 44.

In operation, bandgap circuit 12 provides reference voltage $V_R$ between the $V_{EE}$ power supply rail and circuit node 14 whereby the direction of the arrow represents a voltage rise and, thus, the voltage occurring at circuit node 14 is at a more positive potential with respect to the voltage at power supply rail $V_{EE}$. It is understood that $V_R$ is a predetermined multiple of the bandgap potential whereby the bandgap potential is approximately 1.3 volts and is substantially independent of temperature and power supply variation. One example of an implementation of bandgap circuit 12 that provides a voltage that is substantially independent of temperature and power supply variation is fully described in a pending U.S. patent application having Ser. No. 07/533,199, filed on June 4, 1990, entitled "Voltage Reference Circuit With Power Supply Compensation", and assigned to the same assignee of the subject invention. In a preferred embodiment, assume that operating potential $V_{CC}$ is substantially equal to ground reference, while operating potential $V_{EE}$ is substantially equal to −5 volts. Therefore, it should be realized that battery 30 will provide a potential of 5 volts with the proper polarity as shown in FIG. 1. By simple loop analysis, the total voltage across resistors 16, 20 and 24, $V_T$, can be calculated as:

$$V_T=(V_{EE}-V_R) \quad (1)$$

Further, the voltage drop across resistor 24, $V_1$, which occurs between the $V_{CC}$ power supply rail and node 17, can be calculated as:

$$V_1=\beta\times(V_{EE}-V_R) \quad (2)$$

where $\beta$ is substantially equal to the resistance of resistor 24 divided by the sum of the resistances of resistors 16, 20 and 24. Thus, the value $\beta$ can be varied by varying the value of resistor 24 with respect to the sum of the resistances of resistors 16, 20 and 24.

Likewise, the voltage drop across resistors 20 and 24, $V_2$, which occurs between the $V_{CC}$ power supply rail and node 15, can be calculated as:

$$V_2=(1-\beta)\times(V_{EE}-V_R) \quad (3)$$

It is worth noting that voltages $V_T$, $V_1$ and $V_2$ are all referenced with respect to the $V_{CC}$ power supply rail. Also, for CMOS voltage regulator 10 of FIG. 1, resistor 24 may be substantially equal to resistor 16 and, thus, the voltage across resistor 16 is substantially equal to voltage $V_1$. Further, the voltage occurring at node 17, which is referenced with respect to power supply rail $V_{CC}$, is transferred to terminal 42 via non-inverting operational amplifier 22. Therefore, the voltage appearing at terminal 42, ($V_{42}$), is referenced to power supply $V_{CC}$ and is substantially equal to:

$$V_{42}=V_1=\beta\times(V_{EE}-V_R) \quad (4)$$

In summary, the voltage occurring at terminal 42 is substantially equal to a predetermined adjustable voltage ($V_1$) which can be varied by varying the value of resistor 24 with respect to the sum of the resistances of resistors 16, 20 and 24, wherein the sum of the values of resistors 16, 20 and 24 is a constant.

Voltage $V_2$ which is the voltage occuring across resistors 20 and 24 and which is referenced to power supply rail $V_{CC}$, is translated to the collector of transistor 32 via translator circuit 19 wherein the voltage magnitude at the collector of transistor 32 is substantially equal to the magnitude of voltage $V_2$ but is now referenced with respect to the $V_{EE}$ power supply rail.

In analyzing the operation of translator circuit 19, first assume that current $I_1$ flows through transistors 18 and 28 and resistor 26, while the same current flows through transistors 32, 34 and 36 and resistor 38 due to the current mirror comprised of transistors 28 and 32. By utilizing the fact that the sum of the voltages for any closed loop is substantially equal to zero, one can obtain the following expression for $I_1$:

$$I_1=[V_{EE}-(2\times V_{BE})-V_2]/R_{26} \quad (5)$$

where $V_2$ is the voltage occurring across the base-collector of transistor 18;

$R_{26}$ is the resistance of resistor 26; and one $V_{BE}$ voltage is due to transistor 18 while the other $V_{BE}$ voltage is due to transistor 28 where $V_{BE}$ is the voltage drop across the base-emitter of the respective transistor.

The voltage occurring across the collector-emitter of transistors 32, denoted by $V_2'$, can be calculated as:

$$V_2'=V_{EE}-(I_1\times R_{38})-(2\times V_{BE}) \quad (6)$$

If the resistance of resistor 38 is substantially equal to the resistance of resistor 26, then Eqn. (6) can be combined with Eqn. (5) and voltage $V_2'$ can be expressed as:

$$V_2'=V_2 \quad (7)$$

Hence, Eqn. (7) shows that the magnitude of the voltage at the collector of transistor 32 ($V_2'$) is substantially equal to the magnitude of voltage $V_2$. However, voltage $V_2$ is reference with respect to second power supply rail $V_{CC}$ while voltage $V_2'$ is referenced with respect to first power supply rail $V_{EE}$. In summary, translator circuit 19 has translated a voltage occurring at the base of transistor 18, which is referenced to the $V_{CC}$ power supply rail, to the collector of transistor 32 which is now referenced to the $V_{EE}$ power supply rail. It should be noted that transistors 18, 28, 32, 34 and 36 are all identical devices and, thus, have substantially equal current densities. Further, resistor 26 is substantially equal to resistor 38 as aforementioned.

The voltage occurring at the collector of transistor 32 of translator circuit 19 is level shifted up in voltage by substantially two base-emitter voltages which occur across diode-connected transistors 34 and 36 to insure that the voltage appearing at the non-inverting input of operational amplifier 40 is adequate to insure that operational amplifier 40 is operating within its linear region. This voltage occurring at the non-inverting input of operational amplifier 40 is transferred to terminal 44 via operational amplifier 40 whereby operational amplifier 40 functions to shift down its output voltage by substantially two base-emitter voltages. Thus, the voltage occurring at the output of operational amplifier 40 is substantially equal to the voltage drop across resistors 20 and 24, ($V_2$). Therefore, the voltage appearing at terminal 44, ($V_{44}$), is referenced to power supply rail $V_{EE}$ and is substantially equal to:

$$V_{44}=V_2=(1-\beta)\times(V_{EE}-V_R) \quad (8)$$

In summary, the voltage occurring at terminal 44 is substantially equal to a predetermined adjustable voltage which can be varied by varying the value of resistors 20 or 24 with respect to the sum of the resistances of resistors 16, 20 and 24.

The voltage appearing between terminals 42 and 44 can be calculated by writing a simple loop equation. By using the expressions for $V_{42}$ and $V_{44}$ as respectively calculated in Eqns. (4) and (8), one can conclude that the voltage between terminals 42 and 44 is substantially equal to $V_R$. Further, since $V_R$ is substantially independent of temperature and power supply variation, the voltage between terminals 42 and 44 is also substantially independent of temperature and power supply variation. It should be realized that if power supply rail $V_{EE}$ varies for any reason, voltages $V_1$ or $V_2$ will vary, but the voltage between terminals 42 and 44 will remain substantially equal to voltage $V_R$. Therefore, CMOS voltage regulator 10 provides a regulated voltage between terminals 42 and 44 which is substantially independent of temperature and power supply variations. Further, the regulated voltage supplied between terminals 42 and 44 can be made compatible for powering submicron CMOS circuits by fixing the values of resistors 16, 20 and 24.

The voltage developed at terminal 42, ($V_{42}$), is offset from the $V_{CC}$ power supply rail by the voltage occurring across resistor 24, while the voltage developed at terminal 44, ($V_{44}$), is offset from the $V_{EE}$ power supply rail by the voltage occurring across resistors 20 and 24. It should be noted that the sum of the offset voltages, that is $V_{42}$ and $V_{44}$, is substantially equal to ($V_{EE}-V_R$) by choosing proper design values for resistors 16, 20 and 24. It should also be noted that if identical offset voltages are desired ($V_{42}=V_{44}$), resistor 20 can be set to zero while resistors 16 and 24 are substantially equal. This would yield a $\beta$ value of 0.5. For the circuit shown in FIG. 1, it should be realized that the voltage offset with respect to the $V_{CC}$ power supply rail is smaller than the voltage offset with respect to the $V_{EE}$ power supply rail. However, by exchanging the non-inverting inputs of operational amplifiers 22 and 40 whereby node 17 is coupled to the non-inverting input of operational amplifier 40 while node 15 is coupled to the non-inverting input of operational amplifier 22 via level translator circuit 19, the voltage offset with respect to the $V_{CC}$ power supply rail can be made larger than the voltage offset with respect to the $V_{EE}$ power supply rail. Thus, it an an advantage of the present invention to provide predetermined voltages at terminals 42 and 44 which are offset by predetermined voltages with respect to power supply rails $V_{CC}$ and $V_{EE}$, respectively.

Referring to FIG. 2, a detailed schematic diagram of one implementation for operational amplifier circuit 22 of FIG. 1 is shown comprising transistor 50 having a collector coupled to the $V_{CC}$ power supply rail and an emitter coupled through current source 52 to the $V_{EE}$ power supply rail. The base of transistor 50 is coupled to terminal 54 which acts as the non-inverting input of operational amplifier circuit 22. Transistor 56 has an emitter coupled to the emitter of transistor 50 and a base coupled to the emitter of transistor 58. The collector of transistor 56 is coupled to the gate electrode of PMOS transistor 60 and through resistor 62 to the base of transistor 58. The base of transistor 58 is further coupled to the $V_{CC}$ power supply rail by resistor 66. The collector of transistor 58 is coupled to the $V_{CC}$ power supply rail. The emitter of transistor 58 is also coupled to terminal 68 which acts as the output of operational amplifier circuit 22. The source electrode of PMOS transistor 60 is coupled to the base of transistor 58 and to the collector of transistor 70. The drain electrode of PMOS transistor 60 is coupled to the base of transistor 70 and through resistor 72 to the $V_{EE}$ power supply rail. The emitter of transistor 70 is also coupled to $V_{EE}$ power supply rail.

In operation, the circuit in FIG. 2 functions as an operational amplifier circuit that is capable of sourcing current at terminal 68. The base of transistor 50 is the non-inverting terminal while the base of transistor 56 is the inverting terminal. Further, transistor 58 is capable of sourcing current at terminal 68 which is the output of the operational amplifier circuit of FIG. 2. It is important to note that since the emitter of transistor 58 is coupled to the base of transistor 56, the operational amplifier circuit of FIG. 2 is configured in a non-inverting (voltage follower) mode such that the voltage appearing at the output (terminal 68) will be made substantially equal to the voltage occurring at the non-inverting input (terminal 54). It is worth noting that PMOS transistor 60, transistor 70 and resistor 72 function as a "super PMOS" device to clamp the voltage across resistor 62 to a predetermined voltage, namely, the gate-source voltage ($V_{GS}$) of PMOS transistor 60. Further, if power supply rail $V_{EE}$ increases, additional current will flow through resistor 66 and will be shunted through transistor 70 and, thus, the voltage across resistor 62 will be substantially constant and independent of power supply variation. As a result, if the gate-source voltage of PMOS transistor 60 is less than the base-emitter voltage of transistor 58, then transistor 56 will not enter saturation. It should be realized that PMOS transistor 60, transistor 70 and resistor 72 can be replaced by a PNP transistor wherein the emitter of the PNP transistor is coupled to the base of transistor 58, the base of the PNP transistor is coupled to the collector of transistor 56, and the collector of the PNP transistor is coupled to the $V_{EE}$ power supply rail. The PNP transistor would clamp the voltage across resistor 62 to the base-emitter voltage of the PNP transistor.

Referring to FIG. 3, a detailed schematic diagram of one implementation of operational amplifier circuit 40 of FIG. 1 is shown comprising PMOS transistor 80 having a gate electrode coupled to terminal 82 which acts as the non-inverting input of operational amplifier circuit 40. The source electrode of PMOS transistor 80 is coupled to the collector of transistor 84 and to the drain electrode of PMOS transistor 86. The drain electrode of PMOS transistor 80 is coupled to the base of transistor 84 while the emitter of transistor 84 is coupled to the base of transistor 88 and to both the collector and base of transistor 90. The emitter of transistor 90 is coupled to the collector of transistor 92, the latter having an emitter coupled to the $V_{EE}$ power supply rail. The base of transistor 92 is coupled to the emitter of transistor 94, to the base of transistor 96, and to the base and collector of transistor 98. The emitters of transistors 96 and 98 are both coupled to the $V_{EE}$ power supply rail. The base and collector of transistor 94 are both coupled to the emitter of transistor 100, while the collector of the latter is coupled to the drain electrode of PMOS transistor 86 and to the source electrode of PMOS transistor 102. The base of transistor 100 is coupled to the drain electrode of PMOS transistor 102 while the gate electrode of PMOS transistor 102 is coupled to the base and collector of transistor 104. The gate electrode of PMOS transistor 86 is coupled to the gate and drain electrodes of PMOS transistor 106. The source electrodes of PMOS transistors 86 and 106 as well as the collector of transistor 88 are all coupled to the $V_{CC}$ power supply rail. Resistor 108 is coupled between the $V_{CC}$ power supply rail and the collector of transistor 104. The emitter of transistor 88 is coupled to the collector of transistor 96 and to the base of transistor 110. The collector of transistor 110 is coupled to the emitter of transistor 112 and to terminal 114 which acts as the output of operational amplifier circuit 40. The base and collector of transistor 112 is coupled to the emitter of transistor 104. The emitter of transistor 110 is coupled to the $V_{EE}$ power supply rail. Finally, current source 116 is coupled between the gate electrode of PMOS transistor 106 and the $V_{EE}$ power supply rail.

In operation, the circuit in FIG. 3 functions as an operational amplifier circuit that is capable of sinking current from terminal 114. The gate electrode of PMOS transistor 80 is the non-inverting terminal while the gate electrode of PMOS transistor 102 is the inverting terminal. Further, transistor 110 is capable of sinking current supplied from terminal 114 wherein the collector of transistor 110 is the output of the operational amplifier circuit of FIG. 3. It is important to note that since the collector of transistor 110 is coupled to the gate electrode of PMOS transistor 102, the operational amplifier circuit of FIG. 3 is configured in a non-inverting (voltage follower) mode such that the voltage appearing at the gate electrode of PMOS transistor 102 output will be made substantially equal to the voltage occurring at the non-inverting input (terminal 82). Further, diode-connected transistors 104 and 112 are coupled between the collector of transistor 110 and the gate electrode of PMOS transistor 102 to offset diode-connected transistors 34 and 36 of FIG. 1 which were utilized to insure that operational amplifier 40 operated within the linear region as aforementioned. Likewise to the super PMOS transistor device of FIG. 2, PMOS transistor 80 and transistor 84 can be replaced by a PNP transistor wherein the emitter of the PNP transistor is coupled to the drain electrode of PMOS transistor 86, the base of the PNP transistor is coupled to terminal 82, and the collector of the PNP transistor is coupled to the collector of transistor 90. Similarly, PMOS transistor 102 and transistor 100 can be replaced by a PNP transistor wherein the emitter of the PNP transistor is coupled to the drain electrode of PMOS transistor 86, the base of the PNP transistor is coupled to the collector of transistor 104, and the collector of the PNP transistor is coupled to the collector of transistor 94. It should also be noted that transistors 104 and 112 are identical devices with respect to transistors 34 and 36 and, thus, have substantially equal current densities. Further, resistor 108 is substantially equal to resistors 26 and 38.

By now it should be apparent from the foregoing discussion that a novel circuit has been provided for providing a predetermined regulated voltage positioned between first and second supply voltage rails that is substantially independent of temperature and power supply variations.

We claim:

1. A circuit having first and second supply voltage rails, comprising:

a bandgap circuit coupled between a circuit node and the second supply voltage rail for providing a predetermined reference voltage across said bandgap circuit, said predetermined reference voltage being substantially independent of temperature and power supply variation;

resistive means coupled between the first supply voltage rail and said circuit node for providing voltages which are referenced with respect to the first supply voltage rail at respective first and second outputs;

level translator means having an input coupled to said second output of said resistive means for translating said voltage appearing at said second output of said resistive means to a voltage at an output of said level translator means, said voltage at said output of said level translator means being referenced with respect to said second supply voltage rail;

a first operational amplifier coupled to said first output of said resistive means for transferring said voltage appearing at said first output of said resistive means to a first terminal, said first operational amplifier being capable of sourcing current; and a second operational amplifier coupled to said output of said level translator means for transferring said voltage appearing at said output of said level translator means to a second terminal wherein a voltage developed between said first and second terminals is substantially equal to said predetermined reference voltage of said bandgap circuit, said second operational amplifier being capable of sinking current.

2. The circuit according to claim 1 wherein said resistive means includes:

a first resistor having first and second terminals, said first terminal being coupled to said circuit node, and said second terminal being coupled to said second output of said resistive means;

a second resistor having first and second terminals, said first terminal being coupled to said second terminal of said first resistor, and said second terminal being coupled to said first output of said resistive means; and a third resistor having first and second terminals, said first terminal being coupled to said second terminal of said second resistor, and said second terminal being coupled to the first supply voltage rail.

3. The circuit according to claim 1 wherein said level translator means includes:

a first transistor having a collector, a base and an emitter, said collector being coupled to the first supply voltage rail, and said base being coupled to said input of said level translator means;

a second transistor having a collector, a base and an emitter, said collector and said base being interconnected, and said emitter being coupled to the second supply voltage rail;

a third transistor having a collector, a base and an emitter, said base being coupled to said base of said second transistor, and said emitter being coupled to the second supply voltage rail;

a fourth transistor having a collector, a base and an emitter, said emitter being coupled to said collector of said third transistor;

a fifth transistor having a collector, a base and an emitter, said emitter being coupled to said collector and said base of said fourth transistor, said base and said collector being interconnected and coupled to said second operational amplifier;

a first resistor coupled between said emitter of said first transistor and said collector of said second transistor; and a second resistor coupled between said collector of said fifth transistor and the first supply voltage rail.

4. A circuit having first and second supply voltage rails for providing a regulated output voltage, comprising:

a bandgap circuit coupled between a circuit node and the second supply voltage rail for providing a predetermined reference voltage between said circuit node and said second supply voltage rail, said predetermined reference voltage being substantially independent of temperature and power supply variation;

resistive means, having first and second output terminals, for absorbing the voltage difference between the first and second supply voltage rails lessened by said predetermined reference voltage, wherein respective voltages provided at said first and second output terminals are referenced with respect to the first supply voltage rail;

a voltage level translator having an input coupled to said second output of said resistive means for translating said voltage appearing at said second output terminal of said resistive means which is referenced with respect to the first supply voltage rail to a voltage appearing at an output of said voltage level translator which is referenced with respect to the second supply voltage rail;

a first operational amplifier coupled to said first output terminal of said resistive means for transferring said voltage appearing at said first output terminal of said resistive means to a voltage at a first output of the circuit, said voltage at said first output of the circuit being referenced with respect to the first supply voltage rail, and said first operational amplifier being capable of sourcing current; and a second operational amplifier coupled to said output of said voltage level translator for transferring said voltage appearing at said output of said voltage level translator to a voltage at said second output of the circuit, said second operational amplifier being capable of sinking current, said voltage at said first output of the circuit being shifted down in voltage from the first supply voltage rail by said voltage occurring at said first output terminal of said resistive means, and said voltage at said second output of the circuit being shifted up in voltage from the second supply voltage rail by said voltage occurring at said second output terminal of said resistive means wherein a voltage developed between said first and second output of the circuit is substantially equal to said predetermined reference voltage of said bandgap circuit means.

5. The circuit according to claim 4 wherein said resistive means includes:

a first resistor having first and second terminals, said first terminal being coupled to said circuit node, and said second terminal being coupled to said second output of said resistive means;

a second resistor having first and second terminals, said first terminal being coupled to said second terminal of said first resistor, and said second terminal being coupled to said first output of said resistive means; and a third resistor having first and second terminals, said first terminal being coupled to said second terminal of said second resistor, and said second terminal being coupled to the first supply voltage rail.

6. The circuit according to claim 4 wherein said voltage level translator includes:

a first transistor having a collector, a base and an emitter, said collector being coupled to the first supply voltage rail, and said base being coupled to said input of said level translator means;

a second transistor having a collector, a base and an emitter, said collector and said base being interconnected, and said emitter being coupled to the second supply voltage rail;

a third transistor having a collector, a base and an emitter, said base being coupled to said base of said second transistor, and said emitter being coupled to the second supply voltage rail;

a fourth transistor having a collector, a base and an emitter, said emitter being coupled to said collector of said third transistor;

a fifth transistor having a collector, a base and an emitter, said emitter being coupled to said collector and said base of said fourth transistor, said base and said collector being interconnected and coupled to said second operational amplifier;

a first resistor coupled between said emitter of said first transistor and said collector of said second transistor; and a second resistor coupled between said collector of said fifth transistor and the first supply voltage rail.

7. A voltage reference circuit having first and second supply voltage rails, comprising:

a bandgap circuit, coupled between a circuit node and the second supply voltage rail, for providing a predetermined reference voltage between said circuit node and said second supply voltage rail, said predetermined reference voltage being substantially independent of temperature and power supply variation;

resistive means coupled between the first supply voltage rail and said circuit node for providing first and second voltages respectively at first and second outputs;

a first transistor having a collector, a base and an emitter, said collector being coupled to the first supply voltage rail, and said base being coupled to said first output of said resistive means;

a second transistor having a collector, a base and an emitter, said collector and said base being interconnected, and said emitter being coupled to the second supply voltage rail;

a third transistor having a collector, a base and an emitter, said base being coupled to said base of said second transistor, and said emitter being coupled to the second supply voltage rail;

a fourth transistor having a collector, a base and an emitter, said emitter being coupled to said collector of said third transistor;

a fifth transistor having a collector, a base and an emitter, said emitter being coupled to said collector and said base of said fourth transistor, said base and said collector being interconnected;

a first resistor coupled between said emitter of said first transistor and said collector of said second transistor;

a second resistor coupled between said collector of said fifth transistor and the first supply voltage rail;

a first operational amplifier having non-inverting and inverting inputs and an output, said non-inverting input being coupled to said first output of said resistive means, and said output being coupled to said inverting input and to a first terminal; and a second operational amplifier having non-inverting and inverting inputs and an output, said non-inverting input of said second operational amplifier means being coupled to said collector of said fifth transistor, and said output of said second operational amplifier being coupled to said inverting input of said second operational amplifier and to a second terminal.

8. A method for providing a regulated voltage that is positioned between first and second power supply rails, the method comprising the steps of:

generating a predetermined reference voltage that is substantially independent of temperature and power supply variation;

generating first and second voltages that are referenced with respect to the first power supply rail;

translating said second voltage to a third voltage, said third voltage being referenced with respect to the second power supply rail; and transferring said first and third voltages respectively to first and second terminals wherein a voltage developed between said first and second terminal is substantially equal to said predetermined reference voltage.

* * * * *